United States Patent [19]

Heitmann et al.

[11] 4,190,061

[45] Feb. 26, 1980

[54] METHOD AND APPARATUS FOR PRODUCING A ROD-LIKE TOBACCO FILLER

[75] Inventors: Uwe Heitmann, Schwarzenbek; Wolfgang Steiniger, Börnsen; Uwe Holznagel, Glinde; Hartmut Kaebernick; Joachim Pfannmüller, both of Hamburg; Joachim Reuland, New Börnsen all of Fed. Rep. of Germany

[73] Assignee: Hauni-Werke Körber & Co. KG., Hamburg, Fed. Rep. of Germany

[21] Appl. No.: 821,179

[22] Filed: Aug. 2, 1977

[30] Foreign Application Priority Data

Aug. 6, 1976 [DE] Fed. Rep. of Germany ..... 2635391

[51] Int. Cl.[2] ..... A24C 5/14; A24C 5/39

[52] U.S. Cl. ..... 131/21 B; 131/21 C; 131/21 D; 131/84 C; 226/45

[58] Field of Search ..... 131/21 B, 21 C, 21 D, 131/84 C, 84 R; 226/24, 25, 45; 222/63; 93/1 C, 77 FT

[56] References Cited

U.S. PATENT DOCUMENTS

| | | | |
|---|---|---|---|
| 4,036,238 | 7/1977 | Okumoto | 131/21 D X |
| 4,037,608 | 7/1977 | Wahle | 131/21 B |

*Primary Examiner*—V. Millin

*Attorney, Agent, or Firm*—Peter K. Kontler

[57] ABSTRACT

An adjustable distributor transports particles of tobacco into a stream building zone wherein the tobacco is converted into a stream containing a surplus of particles. The surplus is removed by an equalizing device and the equalized stream is converted into a rod-like filler. An optical level detector monitors the height of the stream ahead of the equalizing device, and a second detector monitors the height of the equalized stream. Signals which are furnished by the detectors are transmitted to the corresponding inputs of a dividing circuit whose output transmits signals which are used to adjust the distributor in such a way that the rate of tobacco transport to the stream building zone is increased when the quantity of removed surplus decreases and vice versa. The equalizing device, together with the second detector, is movable transversely of the tobacco stream in response to signals from a detector which monitors the density of the filler.

13 Claims, 2 Drawing Figures

METHOD AND APPARATUS FOR PRODUCING A ROD-LIKE TOBACCO FILLER

BACKGROUND OF THE INVENTION

The present invention relates to a method and apparatus for forming a rod-like filler which consists of fibrous material, and more particularly to improvements in a method and apparatus for converting a continuous tobacco stream into a continuous rod-like tobacco filler, e.g., a filler which can be draped into cigarette paper or other suitable wrapping material and severed to yield a succession of discrete cigarettes, cigars or cigarillos.

It is known to form a rod-like filler by resorting to a distributor which showers, propels or otherwise advances tobacco or other fibrous material against one side of an elongated stream forming conveyor and by thereupon removing the surplus from an uneven surface of the resulting tobacco stream. The surplus is removed by one or more trimming or equalizing devices which are normally adjacent to that side or surface of the stream which faces away from the conveyor. The term "fibrous material" is intended to denote natural and reconstituted tobacco, substitutes for tobacco, tobacco shreds, fragments of tobacco ribs, tobacco leaves of the type used in the wrappers of cigars or cigarillos, fibrous filter material and analogous substances. For the sake of simplicity, the invention will be described with reference to continuous bodies (streams and fillers or filler rods) which are composed (either primarily or entirely) of tobacco shreds. It is to be understood, however, that the improved method and apparatus can be utilized with equal advantage for the making of fillers or filler rods which consist of other types or sizes of material or reconstituted tobacco, substitutes for tobacco as well as fibrous filter material.

A satisfactory cigarette maker should be capable of producing discrete cigarettes wherein the density of the fillers is constant except, of course, if the cigarette maker is designed to produce cigarettes with dense ends. Constant density is desirable for a number of reasons including savings in tobacco and absence of excessive deviation of the weight of cigarettes from a predetermined optimum weight. This renders it necessary to subject the tobacco stream to at least one trimming or equalizing action because presently known distributors are incapable of feeding tobacco particles at the rate which is necessary to insure the conversion of particles into a tobacco stream of constant density and constant cross-sectional area. Therefore, the distributor of a cigarette maker invariably feeds tobacco particles in such quantities that the stream contains a surplus of tobacco, and such surplus is removed by the trimming device or devices. The trimming device or devices are adjustable, preferably in response to signals furnished by a detector which monitors the density of the stream ahead of the trimming station. As a rule, the trimming device or devices are movable at right angles to the direction of movement of the stream. If the aforementioned conveyor includes or constitutes an elongated channel, the trimming device or devices are placed adjacent to that side of the stream which faces away from the bottom wall of the channel. The removed surplus of tobacco is normally returned into the magazine of the distributor.

In order to form a satisfactory filler, the distributor of a cigarette making machine must deliver tobacco at a rate which invariably suffices to form a tobacco stream wherein each and every increment contains a surplus of tobacco particles. In other words, at least the first trimming or equalizing device must remove a surplus from each and every increment of the stream. On the other hand, the quantity of surplus should be held to a minimum because the removal of surplus invariably involves undesirable comminution of particles. Comminuted particles (e.g., relatively short tobacco shreds) cannot be processed with the same degree of predictability as longer or larger particles and, furthermore, the filling effect of shorter particles is much less satisfactory than that of longer shreds. It has been found that accumulations of shorter shreds in certain portions of the stream adversely affect the quality of the corresponding portion of the filler.

U.S. Pat. No. 3,132,650 to Richter proposes to change the rate of tobacco delivery by the distributor simultaneously with changes in the position of trimming device as a function of changes in the quantity of surplus tobacco. A drawback of the patented apparatus is that it does not embody any means for accurately determining the quantity of surplus.

U.S. Pat. No. 3,338,247 to Labbe discloses an apparatus wherein the surplus is admitted into a separate path in which the surplus is equalized and measured. The results of measurements are used to regulate the operation of the distributor. Such apparatus also exhibit a number of drawbacks, especially that they do not take into consideration the fact that fluctuations in quantity of tobacco forming the stream depend on a number of factors including the rate of feed by the distributor as well as the quality of tobacco, the configuration of tobacco particles, the condition of tobacco and additional factors which influence the conversion of tobacco particles into a stream (such additional factors include the force of air streams which are used to attract tobacco particles to the stream forming conveyor). Since such factors are not predictable (i.e., their effect upon the quantity of tobacco in the stream arises at irregular intervals), the patented apparatus is incapable of accurately determining the rate at which the distributor should feed tobacco particles in order to reduce the surplus which must be removed by the trimming device or devices.

None of the presently known apparatus take into consideration the geometric shape and/or the exact dimensions of the stream which must be trimmed in order to be converted into an equalized stream.

OBJECTS AND SUMMARY OF THE INVENTION

An object of the invention is to provide a novel and improved method of regulating the feed of fibrous material, particularly tobacco, to a stream building zone in such a way that the quantity of surplus particles in the stream is held to a minimum.

Another object of the invention is to provide a method of the just outlined character which insures the formation of a uniform equalized stream despite the fact that the quantity of surplus is much less than in accordance with heretofore known methods.

A further object of the invention is to provide a method according to which the rate of tobacco feed to the stream building zone of a cigarette maker or the like is regulated in dependency on actual dimensions of successive increments of the unequalized stream.

An additional object of the invention is to provide a novel and improved apparatus for the practice of the above outlined method.

A further object of the invention is to provide the apparatus with novel and improved means for monitoring the stream at the surplus removing station.

An ancillary object of the invention is to provide an apparatus which can be installed in existing cigarette makers or the like.

One feature of the invention resides in the provision of a method of producing a continuous rod-like filler consisting of fibrous material, particularly tobacco. The method comprises the steps of transporting fibrous material at a variable rate along a predetermined path on to a stream building or growing station, converting the fibrous material into a continuous stream whose upper surface is normally uneven and which contains fibrous material in excess of that required in the filler, removing the surplus or excess of fibrous material from the stream, monitoring the height of the stream prior and subsequent to the removing step and generating first and second signals whose intensity, duration and/or other characteristics respectively denote the height of the stream prior to removal of the surplus and the height of the remainder of the stream (i.e., the height of the equalized stream), deriving from the first and second signals third signals whose characteristics denote the differences between the characteristics of first and second signals, varying the rate of transport of fibrous material along the predetermined path and on to the stream building station as a function of changes in characteristics of the third signals so as to reduce the rate when the quantity of removed surplus increases and vice versa, and converting the remainder of the stream into a rod-like filler.

The method preferably further comprises the step of shifting the locus or plane of removal of the surplus in a direction substantially transversely of the stream, and the steps of monitoring the density of the filler and regulating the shifting step as a function of changes in density of the filler.

The step of monitoring the height of the stream downstream of the trimming or equalizing station (i.e., subsequent to the surplus removing step) may include varying the characteristics of second signals in direct proportion to the extent of shifting the aforementioned locus or plane transversely of the stream.

The step of monitoring the height of the stream prior to the surplus removing step may include optically scanning the location of the upper surface of the stream, i.e., of that surface from which the trimming or equalizing device removes the surplus.

The step of deriving third signals preferably includes generating third signals each of which is a quotient of the respective first and second signals. This can be achieved by transmitting the first and second signals to the corresponding inputs of a dividing circuit whose output transmits third signals to means for adjusting a distributor or an analogous unit which transports fibrous material at a variable rate to the stream building station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
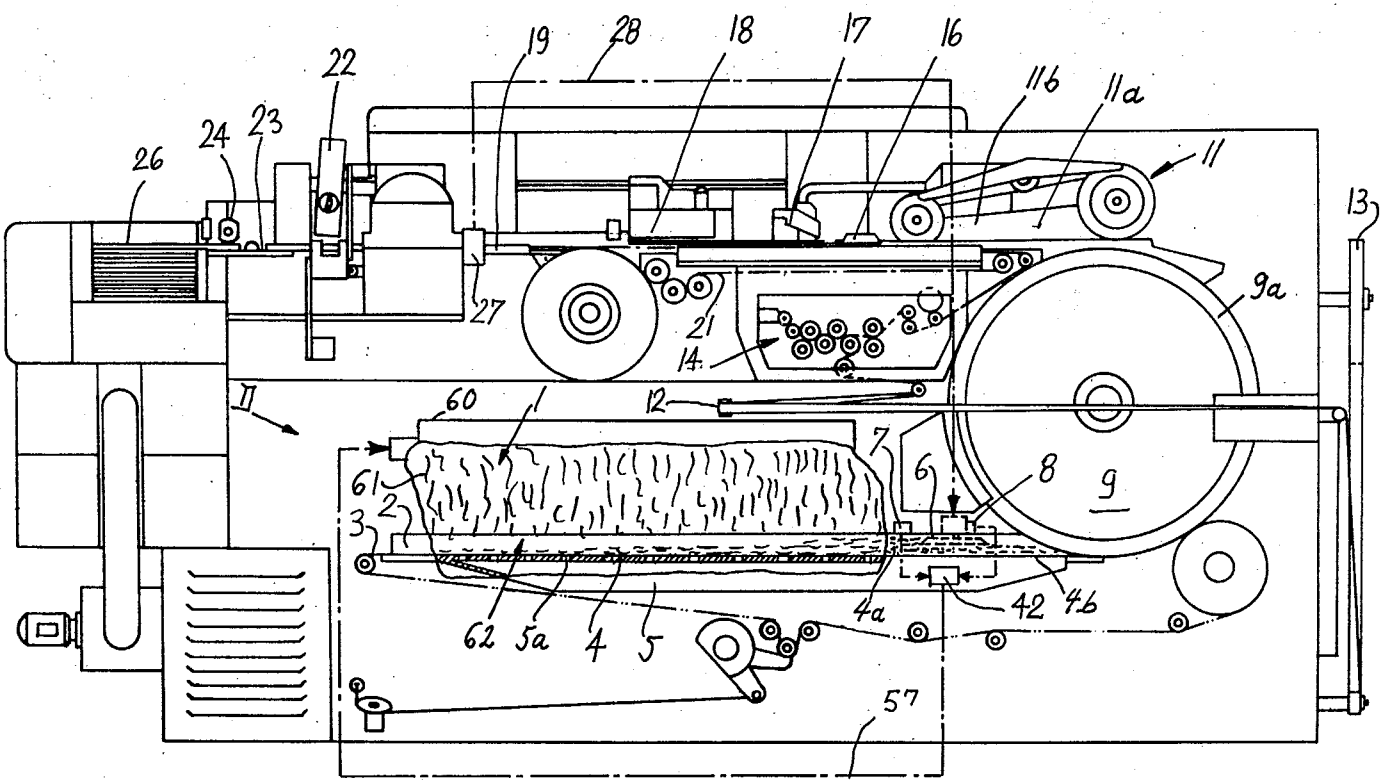
FIG. 1 is a schematic partly elevational and partly sectional view of a cigarette making machine which embodies the improved apparatus.

FIG. 1 shows a cigarette making machine of the type known as GARANT (trademark) manufactured by Hauni-Werke Körber & Co. KG., of Hamburg, Federal Republic Germany. The machine of FIG. 1 includes an apparatus which embodies the present invention. Such apparatus includes a distributor D having an endless band 60 which transports particles 61 of tobacco along an elongated path extending at right angles to the plane of FIG. 1. The particles 61 form a wide layer or carpet 1 and the leader of this carpet is showered into a stream building or growing zone or station 62 where the carpet is converted into an continuous narrow tobacco stream **4*a* which contains tobacco in excess of that required in the filler. The wedge-like growing tobacco stream at the station 62 is shown at 4. The band 60 can transport the particles 61** at a variable rate.

The means for converting the layer 1 into the tobacco stream **4*a* comprises an elongated narrow channel 2 whose upper side is open so that the particles 61 can descend onto the upper reach of an endless foraminous belt conveyor 3. The upper reach of the conveyor 3 travels above the perforated top wall 5*a* of a stationary suction chamber 5 which attracts the growing stream 4 to the conveyor 3 and causes such stream to travel in a direction to the right, as viewed in FIG. 1. The fully grown stream 4*a* continues to move with the upper reach of the conveyor 3 and passes through a surplus removing station where a suitable trimming or equalizing device 6 removes the surplus or excess of particles 61 so that the remainder 4*b* of the stream 4*a* (i.e., the trimmed or equalized stream) contains only such quantities of particles 61 as are necessary to form a satisfactory rod-like tobacco filler. The trimming device 6 is shiftable up and down, as viewed in the drawing (i.e., toward and away from the upper reach of the conveyor 3) by a motor 106** which is actuated in response to changes in density of the tobacco filler.

The equalized stream **4*b* is fed into the circumferential groove 9*a* of a rotary suction wheel 9 which transports the stream 4*b* along an arc of approximately 180 degrees to a level above the conveyor 3. Successive increments of the stream 4*b* at the apex of the suction wheel 9 are caused to adhere to the underside of the lower reach of an endless foraminous belt 11*a* forming part of a transfer conveyor 11. The lower reach of the belt 11*a* travels below the at least partially open underside of a suction chamber 11*b* and serves to transfer the stream 4*b* onto a continuous web 12 of cigarette paper or other suitable flexible wrapping material. The web 12 is withdrawn from a reel 13 and is caused to pass through a conventional imprinting mechanism 14 on its way toward the upper reach of a garniture 21 forming part of a wrapping mechanism 16 wherein the stream 4*b* is converted into a continuous rod-like filler which is wrapped into the web 12 to form therewith a continuous cigarette rod 19. The mechanism 16 further comprises a paster 17 which applies a film of adhesive to one marginal portion of the web 12. Such marginal portion is thereupon folded over the other marginal portion to form therewith a seam which is parallel to the axis of the cigarette rod 19. The seam is stabilized by a sealer 18 which heats the seam if the adhesive is a wet adhesive and which cools the seam if the adhesive is a hotmelt. It will be noted that, for all practical purposes, the equalized stream 4*b* is a rod-like filler; the mechanism 16 merely converts the stream 4*b*** (whose cross-sectional area resembles a polygon) into a substantially rod-like filler.

The cigarette rod 19 is served by a cutoff 22 so that it yields a file of coaxial plain cigarettes 23. Successive cigarettes 23 are accelerated by a rotary cam 24 which propels them into the flutes of a rotary drum-shaped row forming conveyor 26. The latter delivers one or more rows of cigarettes 23 to a filler tipping machine, to storage or to a packing machine. The purpose of the cam 24 is to separate successive cigarettes 23 from each other and to propel them into the flutes of the conveyor 26 while the latter rotates, preferably at a relatively high speed.

The density of the filler which forms part of the rod 19 is monitored by a detector 27 (preferably a beta ray detector or another device including a source of corpuscular radiation) which transmits signals to the shifting motor 106 via conductor means 28. The motor 106 moves the trimming device 6 nearer to the conveyor 3 when the density of the filler increases, and vice versa.

Figure 2:
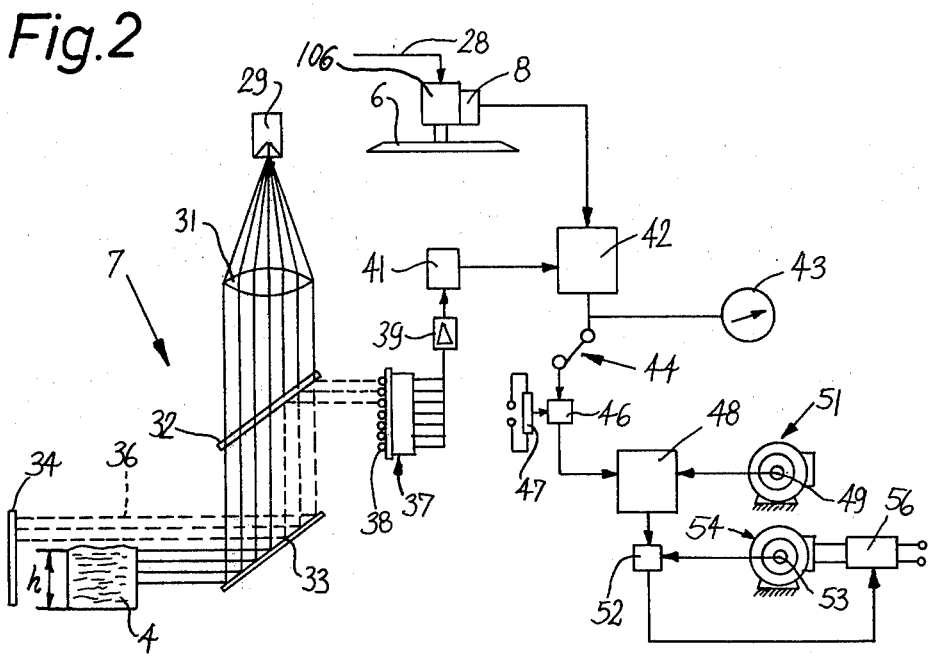
FIG. 2 is a circuit diagram of certain parts of the improved apparatus.

The improved apparatus further comprises a detector 7 which monitors the height of the stream **4*a* upstream of the trimming device 6 (i.e., prior to removal of the surplus) and a detector 8 which monitors the height of the equalized stream 4*b*. The detector 7 comprises a light source 29, and optical system 31 which directs (parallel) rays issuing from the source 29 against a partly light transmitting mirror 32, a fully reflecting mirror 33 which is located in the path of light rays passing through the mirror 32, and a mirror 34 which reflects light rays coming from the mirror 33. The stream 4*a* is caused to advance in the space between the mirrors 33 and 34 at right angles to the plane of FIG. 2; this stream absorbs some light rays and allows the remaining light rays (indicated by broken lines, as at 36) to reach the mirror 34. The latter reflects the rays 36 toward the mirror 33 which, in turn, reflects the once-reflected rays 36 against the underside of the mirror 32. The mirror 32 reflects the rays 36 against the corresponding elements of a battery or row of photoelectric cells 38 forming part of a transducer 37 serving as a means for transmitting first electric signals to an amplifier 39 which is connected to the input of a summing circuit 41. In the embodiment of FIG. 2, the detector 7 comprises seven cells 38. The intensity and/or another characteristic of first signals which are transmitted to the amplifier 39 is a function of the height of the tobacco stream 4*a*. The purpose of the circuit 41 is to totalize the signals furnished by cells 38 which receive light rays 36 so that the intensity of signals at its output denotes the height h of the corresponding portions of the stream 4*a*. The intensity of signals at the output of the circuit 41 respectively increases and decreases proportionally with decreasing and increasing height of the stream 4*a*. The circuit 41 transmits first signals to the corresponding input of a dividing circuit 42**, e.g., a circuit of the type sold by Analog Devices under the designation AD 530.

Another input of the dividing circuit 42 receives second signals from the detector 8 which is shiftable with the trimming device 6 in response to signals transmitted from detector 27 to motor 106 via conductor means 28. The detector 8 may constitute an inductive distance measuring device of the type sold by Collins Corporaton under the designation Linear Motion SS-104, S/M 4886. The detector 8 may serve the dual purpose of indicating the position of the device 6 and of transmitting signals to the circuit 42.

The dividing circuit 42 constitutes a means for deriving from first signals (furnished by detector 7) and from second signals (furnished by detector 8) third signals whose intensity of another characteristic denotes the difference between the characteristics of the first and second signals, and the output of the circuit 42 transmits such third signals to a device which adjusts the distributor 60 in such a way that the rate of transport of tobacco particles 61 to the station 62 is reduced when the quantity of particles forming the surplus increases and vice versa. More specifically, each third signal is a quotient of the corresponding first and second signals. The intensity of third signals can be determined by observing the scale of an indicating instrument 43 connected to the output of the circuit 42. This output is further connected to one input of a subtracting circuit 46 in response to closing of a switch 44. Another input of the circuit 46 receives a reference signal from an adjustable potentiometer 47 or another suitable source of reference signals. The reference signal denotes the desired surplus of tobacco particles 61 in the stream **4*a*. The signal at the output of the circuit 42 denotes the actual surplus of particles 61 in the stream 4*a*. The output of the subtracting circuit 46 is connected with one input of a multiplexer 48 (e.g., a circuit of the type known as AD 530 sold by Analog Devices). The signal from 46 to 48 denotes the difference between the actual and desired surplus. Another input of the multiplexer 48 is connected with a tachometer generator 49 which monitors the speed of a variable-speed motor 51 constituting the main prime mover of the cigarette making machine. The output of the circuit 48 transmits a signal which is indicative of the surplus removed by the equalizing device 6**.

The output of the multiplexer 48 transmits the signal which denotes the surplus to a signal comparing junction 52 which further receives signals from a tachometer generator 53 serving to monitor the RPM of a variable-speed electric motor 54 for the band 60 in the distributor D. The junction 52 transmits a positive or negative signal to an adjustable output amplifier 56 serving to regulate the speed of the motor 54 and hence the rate at which the band 70 delivers tobacco particles 61 to the stream building station 62. In the embodiment of FIG. 2, the junction 52 would transmit a positive signal which would cause the amplifier 56 to increase the RPM of the motor 54. The operative connection between the circuit 42 and the band 60 is indicated in FIG. 1 by a phantom line 57. This line denotes the parts shown in the lower right-hand portion of FIG. 2.

The switch 44 is opened during the initial stage of operation of the machine, i.e., immediately after starting of the motors 51 and 54 and while the channel 2 is still empty.

The improved apparatus is susceptible of many modifications without departing from the spirit of the invention. For example, the detector 8 can be replaced with a detector similar to the optical level detector 7. Also, the circuit 42 can be replaced with a subtracting circuit.

An important advantage of the improved apparatus is that, by determining the geometric shape of the tobacco stream, and more particularly of the configuration of the upper surface of the stream, the regulation of tobacco feed to the stream building zone 62 can be effected in dependency on another parameter which is a function of the mode of operation of the equalizing device 6. This insures that the quantity of tobacco particles forming the surplus can be caused to more accurately conform to the characteristics of tobacco and that such quantity can be adjusted with a minimum of delay.

Without further analysis, the foregoing will so fully reveal the gist of the present invention that others can, by applying current knowledge, readily adapt it for various applications without omitting features that, from the standpoint of the prior art, fairly constitute essential characteristics of the generic and specific aspects of our contribution to the art and, therefore, such adaptations should and are intended to be comprehended within the meaning and range of equivalence of the claims.

What is claimed is:

1. A method of producing a continuous filler of fibrous material, particularly tobacco, comprising the steps of transporting fibrous material at a variable rate along a predetermined path; converting such material into a continuous stream which contains fibrous material in excess of that required in the filler; removing the surplus of fibrous material from said stream; monitoring the height of said stream prior and subsequent to said removing step and generating first and second signals whose characteristics respectively denote the height of the stream prior to removal of said surplus and the height of the remainder of said stream; deriving from said first and second signals third signals having characteristics denoting the differences between the characteristics of said first and second signals; varying the rate of transport of fibrous material along said path as a function of changes in the characteristics of said third signals so as to reduce said rate when the quantity of removed surplus increases and vice versa; and converting said remainder of said stream into said filler.

2. A method as defined in claim 1, further comprising the step of shifting the locus of removal of said surplus in a direction substantially transversely of said stream.

3. A method as defined in claim 2, further comprising the steps of monitoring the density of said filler and regulating said shifting step as a function of changes in density of said filler.

4. A method as defined in claim 2, wherein said step of monitoring the height of said stream subsequent to said removing step includes varying the characteristics of said second signals in direct proportion to the extent of shifting of said locus substantially transversely of said stream.

5. A method as defined in claim 1, wherein said step of monitoring the height of said stream prior to said removing step includes optically scanning the location of the upper surface of said stream.

6. A method as defined in claim 1, wherein each of said third signals is a quotient of the corresponding first and second signals.

7. Apparatus for producing a continuous filler of fibrous material, particularly tobacco, comprising adjustable means for transporting fibrous material at a variable rate along a predetermined path; means for converting said fibrous material into a continuous stream which contains fibrous material in excess of that required in the filler; means for removing the surplus of fibrous material from said stream; means for monitoring the height of said stream ahead of and downstream of said removing means, including means for generating first and second signals whose characteristics respectively denote the height of said stream prior to removal of said surplus and the height of the remainder of said stream; means for deriving from said first and second signals third signals having characteristics denoting the differences between the characteristics of said first and second signals; means for adjusting said transporting means as a function of changes in characteristics of said third signals so as to reduce said rate when the quantity of removed surplus increases and vice versa; and means for converting the remainder of said stream into said filler.

8. Apparatus as defined in claim 7, further comprising means for shifting said removing means substantially transversely of said stream.

9. Apparatus as defined in claim 8, further comprising means for monitoring the density of said filler and means for actuating said shifting means as a function of changes in density of said filler.

10. Apparatus as defined in claim 9, wherein said density measuring means includes a source of corpuscular radiation.

11. Apparatus as defined in claim 8, wherein said means for monitoring the height of said stream downstream of said removing means is shiftable with said removing means and includes an inductive distance measuring device.

12. Apparatus as defined in claim 7, wherein said means for monitoring the height of said stream ahead of said removing means comprises an optical level detector.

13. Apparatus as defined in claim 7, wherein said deriving means includes a dividing circuit having first and second inputs for said first and second signals and an output for said third signals, said third signals constituting quotients of the respective first and second signals.

* * * * *